US007855692B2

(12) United States Patent
Koboyashi et al.

(10) Patent No.: US 7,855,692 B2
(45) Date of Patent: Dec. 21, 2010

(54) METHOD OF ALIGNING ANTENNA AZIMUTH

(75) Inventors: Shinya Koboyashi, Tokyo (JP); Kanemi Sasaki, Tokyo (JP); Hiroyuki Yasuda, Tokyo (JP); Koji Moriya, Tokyo (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 241 days.

(21) Appl. No.: 11/905,985

(22) Filed: Oct. 5, 2007

(65) Prior Publication Data

US 2008/0316132 A1 Dec. 25, 2008

Related U.S. Application Data

(63) Continuation of application No. PCT/JP2006/307427, filed on Apr. 7, 2006.

(30) Foreign Application Priority Data

Apr. 8, 2005 (JP) ..... 2005-112807

(51) Int. Cl.
*H01Q 3/04* (2006.01)

(52) U.S. Cl. ..... 343/760; 343/894; 33/286

(58) Field of Classification Search ..... 343/757, 343/720, 725, 760, 894; 33/286, 275 R, 33/282, 297; 342/359
See application file for complete search history.

(56) References Cited

U.S. PATENT DOCUMENTS 3,908,282 A * 9/1975 Steffan ..... 42/121
3,920,335 A * 11/1975 Seehase ..... 356/138
4,616,421 A 10/1986 Forsen ..... 33/233
6,225,955 B1 * 5/2001 Chang et al. ..... 343/720
6,868,615 B2 * 3/2005 Malley ..... 33/297

FOREIGN PATENT DOCUMENTS

| | | |
|---|---|---|
| JP | 61-072909 | 4/1986 |
| JP | 7-332964 | 12/1995 |
| JP | 2002-077036 | 3/2002 |
| JP | 2002-111335 | 4/2002 |
| JP | 2002-135017 | 5/2002 |
| JP | 2004-072557 | 3/2004 |
| JP | 2004-253921 | 9/2004 |

* cited by examiner

*Primary Examiner*—Michael C Wimer
(74) *Attorney, Agent, or Firm*—Jacobson Holman PLLC

(57) ABSTRACT

There is disclosed a method of aligning an azimuth of an antenna by use of an antenna azimuth aligning instrument capable of economically and precisely aligning the azimuth in a case where a direction of a main beam of a directional antenna is matched with a counter antenna. There is provided a method of aligning the azimuth of the directional antenna by use of the antenna azimuth aligning instrument to be attached to the antenna for use in radio communication, the azimuth aligning instrument includes an aiming hole whose central axis is constituted in parallel with a main beam azimuth of the antenna and in which a diameter of an opening 2C on an operator's viewing side is set to be larger than that of an opening 2B on a target side, and the azimuth of the antenna is aligned using the centers of the two openings of the aiming hole as aims for a target.

4 Claims, 17 Drawing Sheets

RELATION BETWEEN HOLE DIAMETERS: 2B<2C

RELATION BETWEEN HOLE DIAMETERS:3B<3C

CENTER OF 6B IS ALIGNED WITH THAT OF 6C

CENTER OF 6B DEVIATES FROM THAT OF 6C

METHOD OF ALIGNING ANTENNA AZIMUTH

This is a continuation of PCT/JP06/307427filed Apr. 7, 2006 and published in Japanese.

TECHNICAL FIELD

The present invention relates to a method of aligning an antenna azimuth in installing outdoors an antenna having directivity of pencil beam characteristics for use in a communication frequency band such as a sub-millimeter-wave band or a millimeter-wave band, optical communication, or the like.

BACKGROUND ART

In a communication network of a communication company, a radio device of a subscriber and a radio device for a self line, a sub-millimeter-wave band or a millimeter-wave band having comparatively high frequencies is frequently used, or optical communication or the like is also used for effective use of a frequency and from characteristics of a broad band system. Especially in the former case, as an antenna for the radio device, there is used a parabola antenna having pencil beam characteristics capable of obtaining a high gain, or a planar antenna in which a plurality of antenna unit elements are arranged in an array form. As a method of aligning an azimuth of such an antenna having the directivity, a method has been used in which an optical aiming unit shown in FIG. 8 is attached in parallel with a main beam of the antenna whose azimuth is to be aligned, and a target such as a counter antenna is aligned with the center of such a graduation line as shown in FIG. 9 with naked eyes.

However, since the optical aiming unit is expensive and is more expensive than an antenna main body sometimes, the unit cannot be attached as a standard, and is used as a tool for an antenna installation work in many cases. Especially in a sub-millimeter-wave, millimeter-wave or optical communication in which it is technically difficult to obtain a large transmission power, a pencil beam antenna having a large gain is indispensable, and it is a large theme to economically provide means for aligning the azimuth of this antenna for promotion of use of the frequency band.

Moreover, as means for solving the above-mentioned problem, a station antenna of a subscriber is proposed in which a central axis of a viewing hole formed at a peripheral portion of an antenna portion and a central axis of a viewing hole formed at an attachment fitting for attaching the antenna portion and a radio portion to a column have the same direction as that of the directivity of the antenna portion, and these central axes are arranged along the same line.

However, there has been a problem that when a sufficient distance is not disposed between an opening on a target side and an opening on an operator's viewing side, precision cannot be achieved.

An example of FIG. 6 will be described.

When a distance H between an opening 6B on a target side and an opening 6C on an operator's viewing side is small, deviation is generated in accordance with a viewing position of a visual position 6A, that is, a distance A. FIG. 7 shows that the operator looks through an aiming hole structure at this time. That is, in this example, a distance h in FIG. 7 seems to be large, but the distance H decreases or the distance A increases, depending on a ratio between the distance H as a thickness of the aiming hole structure and the distance A from the opening 6B on the target side to the visual position 6A viewed from the opening. In consequence, the opening 6B on the target side is superimposed on the opening 6C on the operator's viewing side, and distinction cannot be made. In this case, it cannot be judged whether or not a visual point or position deviates, and therefore the antenna cannot be installed in an appropriate direction.

Patent Document 1: Japanese Patent Application Laid-Open No. 2004-72557

DISCLOSURE OF THE INVENTION

Problem to be solved by the Invention

To solve the problem, during installation of an antenna, the antenna is economically and precisely installed so that a main beam is appropriately directed with respect to a target, that is, a counter antenna.

Moreover, an object of the present invention is to provide a method of aligning an antenna azimuth in which even an operator unused to an operation of regulating the antenna azimuth can look through an aiming hole for azimuth alignment at appropriate position and angle, so that the azimuth of the antenna can more correctly be regulated.

Means for Solving the Problem

The present invention has been developed in view of the above problem, and there is provided a method of aligning an azimuth of a directional antenna by use of an antenna azimuth aligning instrument to be attached to the antenna for use in radio communication, the azimuth aligning instrument includes an aiming hole whose central axis is constituted in parallel with a main beam azimuth of the antenna and in which a diameter of an opening on an operator's viewing side is set to be larger than that of an opening on a target side, and the azimuth of the antenna is aligned using the centers of the two openings of the aiming hole as aims for a target.

Moreover, according to the present invention, there is provided a method of aligning an azimuth of a directional antenna by use of an antenna azimuth aligning instrument to be attached to the antenna for use in radio communication, the azimuth aligning instrument includes an aiming hole whose central axis is constituted in parallel with a main beam azimuth of the antenna, and a plurality of holes or marks disposed at positions symmetric with respect to the center of an opening of the aiming hole in the vicinity of the opening on an operator's viewing side and configured to be viewed at specific distances and angles from the aiming hole, and the azimuth of the antenna is aligned using the center of the opening of the aiming hole on the operator's viewing side and the center of an opening on a target side as aims for a target from a position where the plurality of holes or marks of the azimuth aligning instrument are equally seen.

EFFECT OF THE INVENTION

In a method of aligning an azimuth of an antenna having directivity of pencil beam characteristics, an operation of precisely aligning the azimuth of the antenna can securely be performed with a simple structure without using any expensive aiming unit, and the method can largely economically be realized.

Moreover, according to the present invention, in the method of aligning the azimuth of the antenna, the azimuth of the antenna is aligned using an azimuth aligning instrument including an aiming hole whose central axis is constituted in parallel with a main beam azimuth of the antenna and in which a diameter of an opening on an operator's viewing side is set to be larger than that of an opening on a target side, and using the centers of the two openings of the aiming hole as aims for a target. In consequence, there is an effect that deviation of a position of the target can easily be checked, and the azimuth of the antenna can securely be aligned with a simple structure.

Furthermore, according to the present invention, in the method of aligning the azimuth of the antenna by use of an antenna azimuth aligning instrument including an aiming hole whose central axis is constituted in parallel with a main beam azimuth of the antenna, and a plurality of holes or marks disposed at positions symmetric with respect to the center of an opening of the aiming hole in the vicinity of the opening on an operator's viewing side and configured to be viewed at specific distances and angles from the aiming hole, the azimuth of the antenna is aligned using the center of the opening of the aiming hole on the operator's viewing side and the center of an opening on a target side as aims for a target from a position where the plurality of holes or marks of the azimuth aligning instrument are equally viewed. In consequence, when an operator looks through the aiming hole and simply confirms that the plurality of holes or marks are equally seen, the aiming hole can be viewed at the appropriate distances and angles. Even an operator unused to the operation can align the azimuth of the antenna from a correct position, and this produces an effect that precision of the azimuth alignment can be improved.

DESCRIPTION OF REFERENCE NUMERALS

11 antenna
12 attachment pole
13 antenna attachment fitting
14 elevation angle regulation mechanism
15 aiming hole structure
16*a*, 16*b*, 16*c* aiming holes
2B, 3B, 4B, 4D, 6B, B openings of aiming hole structures on a target side
2C, 3C, 4C, 4E, 6C, E openings of aiming hole structures on an operator's viewing side
3D stepped point at stepped surface 3E
3E stepped surface
6A visual position
F1, F2 holes
G1, G2 surfaces
K1, K2 marks

BEST MODE FOR CARRYING OUT THE INVENTION

An embodiment is realized by disposing an aiming hole in which a diameter of an opening on an operator's viewing side is set to be larger than that of an opening on a target side along the same central axis of the aiming hole.

Embodiment 1

One embodiment of the present invention will hereinafter be described with reference to the drawings.

Figure 1:
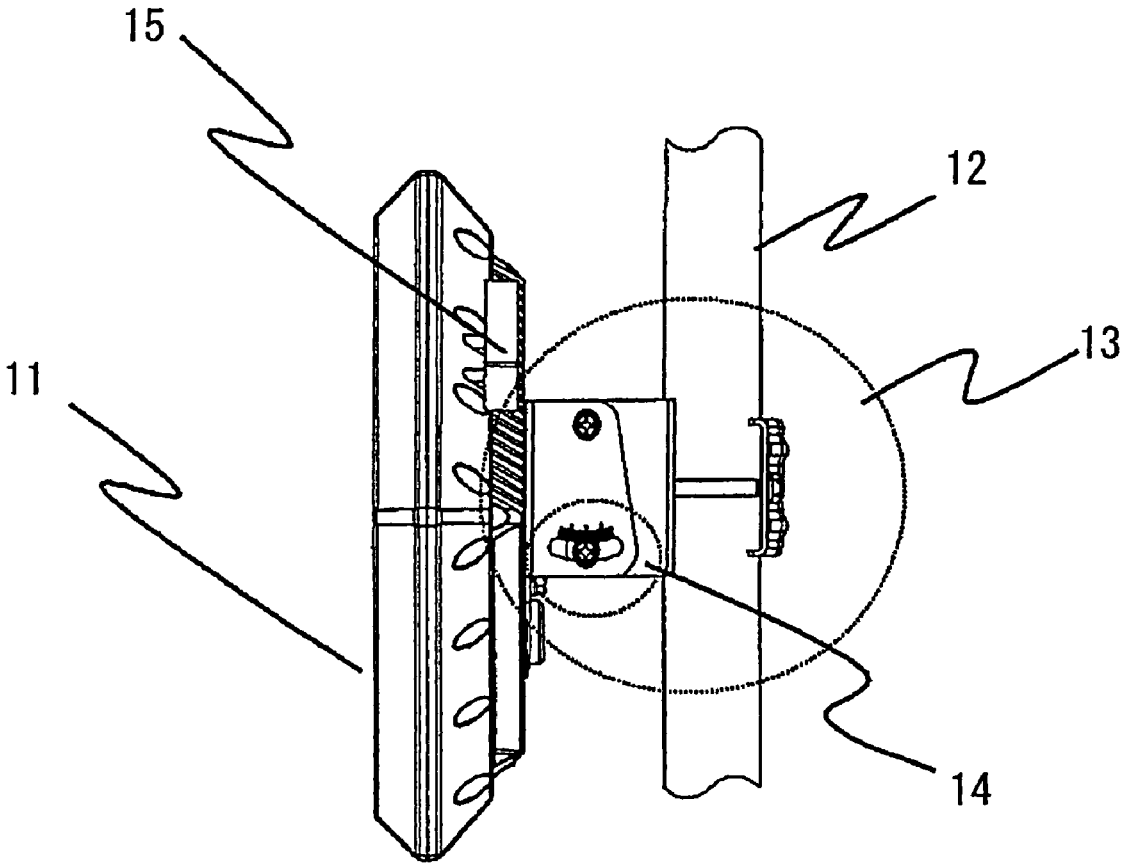
FIG. 1 shows one embodiment of antenna attachment according to the present invention.
Figure 2A:
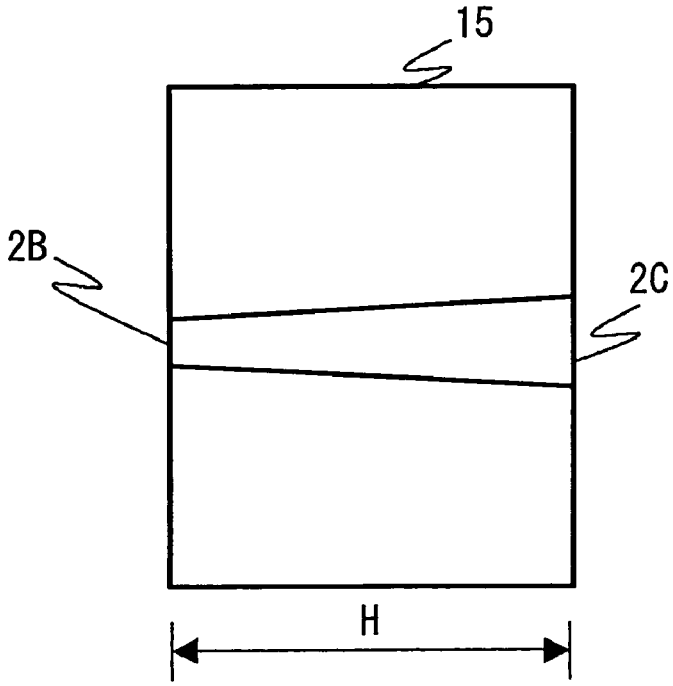
FIGS. 2A,2B show an aiming hole structure and a target when viewed according to a first embodiment of the present invention.
Figure 2B:
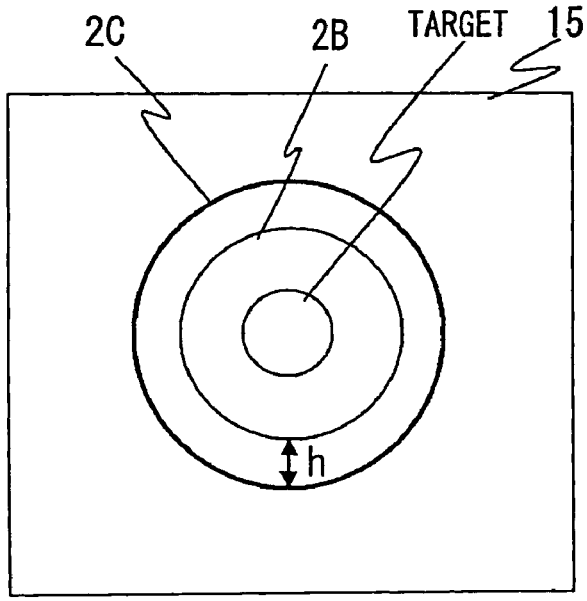

FIG. 1 shows one embodiment of antenna attachment according to the present invention, and FIG. 2A,2B show a first embodiment as one embodiment of a method of aligning an azimuth of an antenna as shown in FIG. 1 according to the present invention.

In a constitution of the present invention, as shown in FIG. 1, an antenna 11 is provided with an aiming hole structure 15 as an antenna azimuth aligning instrument, the antenna 11 is attached to an attachment pole 12 via an antenna attachment fitting 13, and the antenna attachment fitting 13 is provided with an elevation angle regulation mechanism 14. There are two regulating directions of the antenna attachment fitting 13 including a direction in which the fitting is swung horizontally with respect to the attachment pole 12 and a direction in which the antenna attachment fitting 13 itself provided with the elevation angle regulation mechanism is vertically swung.

Figure 6A:
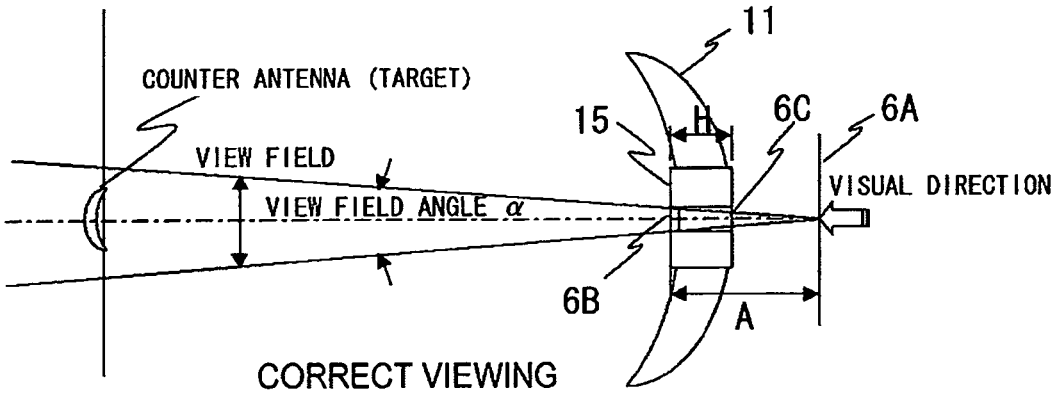
FIG.6A (PRIOR ART)
FIGS. 6A,6B are a method of aligning an azimuth of an antenna according to a conventional technology.
Figure 6B:
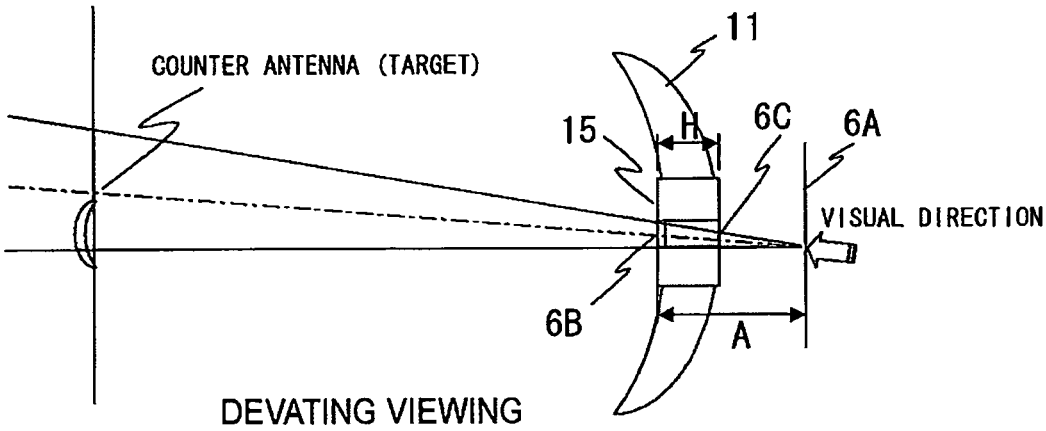
FIG.6B (PRIOR ART)
Figure 7A:
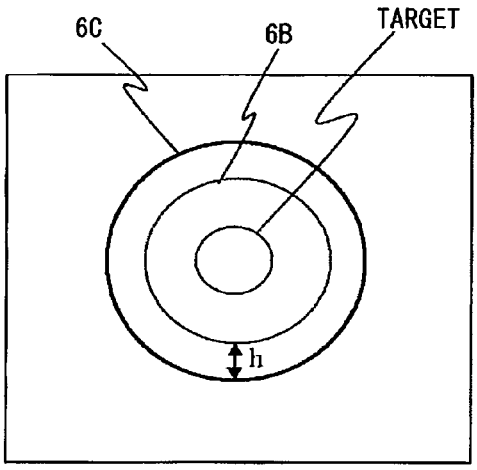
FIG.7A (PRIOR ART)
FIGS. 7A,7B show an aiming hole and a target when viewed according to an aiming hole structure of the conventional technology.
Figure 7B:
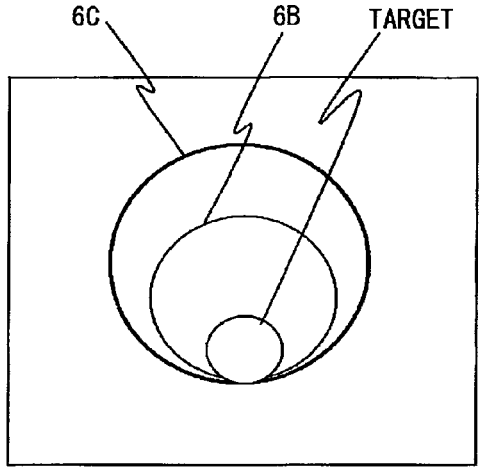
FIG.7B (PRIOR ART)
Figure 8:
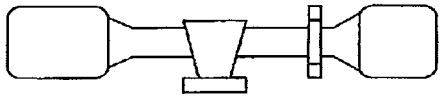
FIG.8 (PRIOR ART)
FIG. 8 is an optical aiming unit used in the conventional technology.
Figure 9:
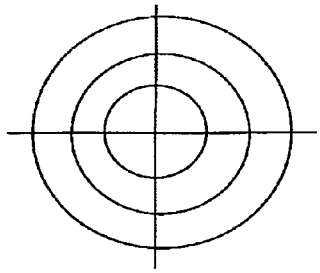
FIG.9 (PRIOR ART)
FIG. 9 shows a view of the optical aiming unit used in the conventional technology.

FIG. 2 shows the aiming hole structure and a target when viewed according to the first embodiment. The whole method of aligning the azimuth of the antenna is substantially the same as that of a conventional technology of FIG. 6, but the method is characterized by the aiming hole structure. In FIG. 2A, a diameter of an opening 2C on an operator's viewing side is set to be larger than that of an opening 2B on a target side. Even when a distance H is equal to a distance H between an opening 6B on the target side and an opening 6C on an operator's viewing side according to the conventional technology of FIG. 6, deviation between the opening on the target side and the opening on the operator's viewing side is indicated to be large, whereby an operation of aligning the azimuth of the antenna can further be facilitated.

When the diameter of the opening on the operator's viewing side is set to be larger than that of the opening on the target side along the same central axis in this manner, that is, two openings are formed in a tapered form, the aiming hole structure 15 is suitable for resin molding and die cast molding in consideration of productivity, and the aiming hole structure 15 itself can largely inexpensively be prepared.

It is to be noted that a shape of a hole provided at the aiming hole structure 15 is not limited to a circular shape, and even if any shape such as an elliptic shape or a rectangular shape is used, the operation of aligning the azimuth of the antenna can sufficiently be facilitated.

Embodiment 2

The next embodiment of the present invention will hereinafter be described with reference to the drawings.

Figure 3A:
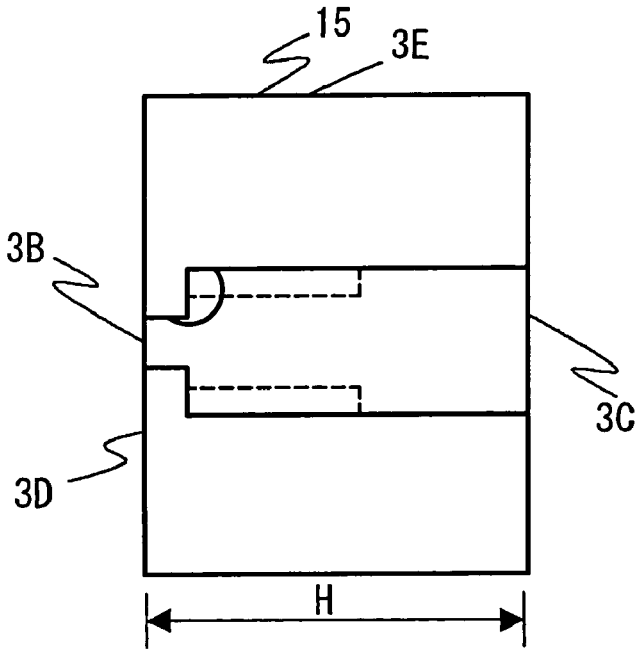
FIGS. 3A,3B show an aiming hole structure and a target when viewed according to a second embodiment of the present invention.
Figure 3B:
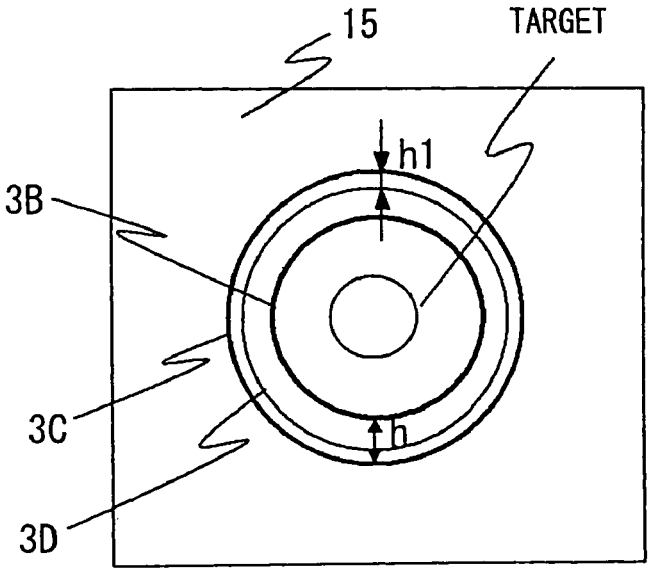

FIG. 3A,3B show an aiming hole structure and a target when viewed according to a second embodiment of a method of aligning an azimuth of an antenna in FIG. 1 of the present invention.

FIG. 3 is substantially the same as the above embodiment in that a diameter of an opening 3C on an operator's viewing side is set to be larger than that of an opening 3B on a target side, but the present embodiment is characterized in that an aiming hole is provided with a stepped surface 3E between the opening 3B on the target side and the opening 3C on the operator's viewing side along the same central axis. Since the stepped surface is disposed, a visual aim at a time when an operator looks through the aiming hole can further easily be focused, and a boundary is set to be conspicuous so that viewing deviation can easily be seen. Moreover, in FIG. 3B, hl visually generated between the opening 3C on the operator's viewing side and a stepped point 3D of the stepped surface 3E seems to be small, and hence irregular reflection due to incident light from the opening on the target side can be inhibited.

The formation of such a stepped portion at this aiming hole is suitable for drill processing during production in small quantities, and the aiming hole structure itself can largely inexpensively be prepared. When color of the stepped surface E is changed or the surface is provided with a graduation, vertical and horizontal gaps can easily be adjusted.

Moreover, in FIG. 3A of the embodiment, the stepped surface E is disposed at the opening on the target side, but it is not limited that the stepped surface E is disposed at the opening on the target side, the number of the stepped surfaces may be increased as shown by dot lines in FIG. 3A, or a position of the stepped surface may be changed to realize the constitution. Especially, when the number of the stepped surfaces is increased, reference alignment as aiming is further facilitated, and this is also effective in a case where a distance between the opening 3C on the operator's viewing side and the visual position is reduced.

Embodiment 3

The next embodiment of the present invention will hereinafter be described with reference to the drawings.

Figure 4:
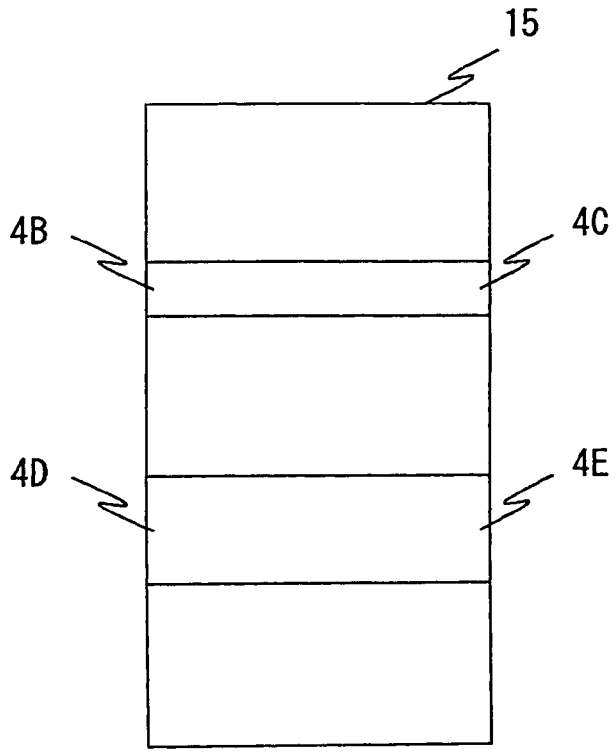
FIG. 4 shows an aiming hole structure and a target when viewed according to a third embodiment of the present invention.

FIG. 4 shows an aiming hole structure and a target when viewed according to a third embodiment of a method of aligning an azimuth of an antenna in FIG. 1 of the present invention.

FIG. 4 shows that the aiming hole structure is provided with a plurality of holes having different diameters. In this embodiment, when a distance to the target is short, an aiming hole 4D-4E having a large diameter is used. When the distance to the target is long, an aiming hole 4B-4C having a small diameter is used. To align the azimuth of the antenna, the azimuth is coarsely regulated with the aiming hole having a large hole diameter, and finely regulated with the aiming hole having a small hole diameter. When the aiming holes are selectively used in this manner, an efficiency of an operation of aligning the azimuth of the antenna can further be improved.

Embodiment 4

The next embodiment of the present invention will hereinafter be described with reference to the drawings.

Figure 5:
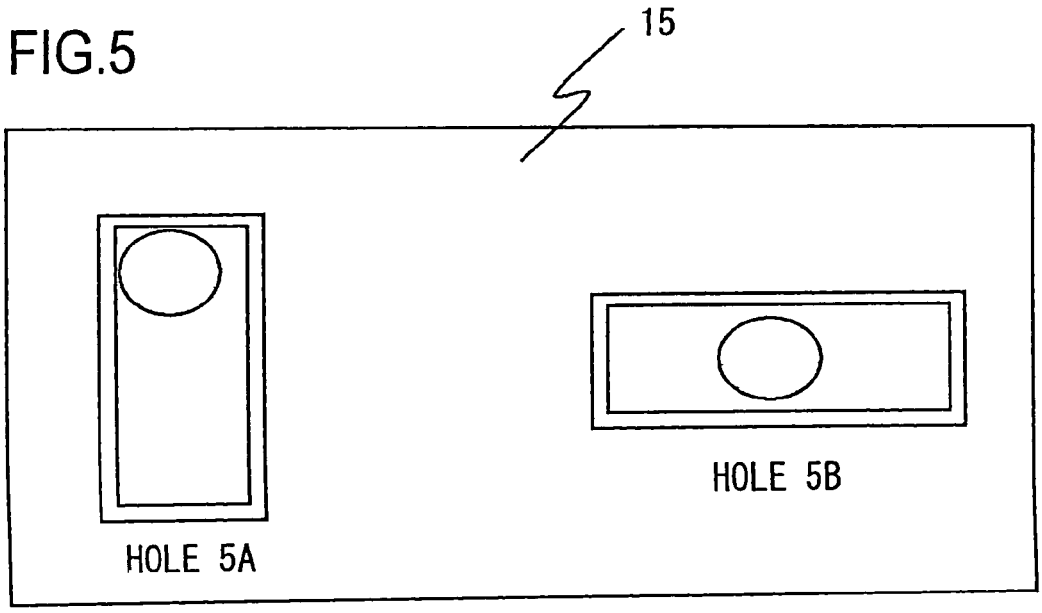
FIG. 5 shows an aiming hole structure and a target when viewed according to a fourth embodiment of the present invention.

FIG. 5 shows an aiming hole structure and a target when viewed according to a fourth embodiment of a method of aligning an azimuth of an antenna in FIG. 1 of the present invention.

In FIG. 5, instead of circular viewing holes, two holes including a vertically long hole and a horizontally long hole are disposed. In this embodiment, a regulating direction of an attachment fitting can be matched. As shown in FIG. 1, an antenna attachment fitting is usually fixed to a rod referred to as an attachment pole. The regulating direction of the antenna attachment fitting includes two directions of a direction in which the fitting is swung horizontally with respect to the attachment pole and a direction in which the attachment fitting itself provided with an elevation angle regulation mechanism is vertically swung. In a case where a horizontal direction is regulated in a state in which the fitting deviates in a vertical direction, the regulation is performed using a hole 5A. Conversely, in a case where the vertical direction is regulated in a state in which the fitting deviates in the horizontal direction, a hole 5B is used. According to this method, both of the vertical direction and the horizontal direction can be regulated at once, whereas the vertical direction and the horizontal direction have heretofore been regulated alternately to adjust the direction.

Furthermore, the method of aligning the azimuth of the antenna in the vertical and horizontal directions has been described above, but the method is not limited to the vertical and horizontal directions, an angle may be changed in consideration of balance with the regulation method of the attachment fitting, or a plurality of holes may be disposed to realize the method so that many angles can be handled.

Embodiment 5

Figure 10A:
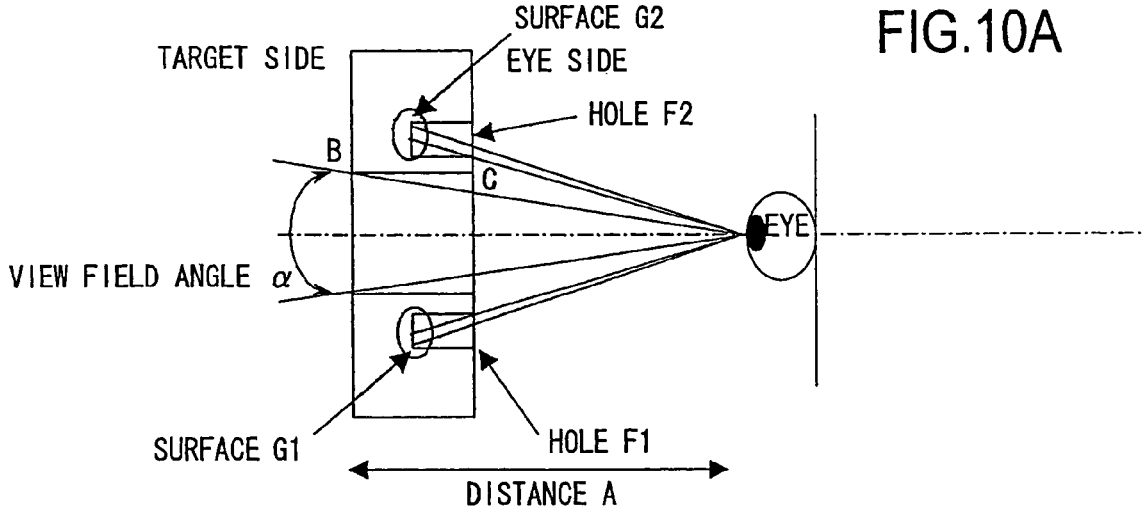
FIG. 10A is a sectional explanatory diagram showing an aiming hole structure and a method of aligning an azimuth of an antenna according to a fifth embodiment of the present invention.
Figure 10B:
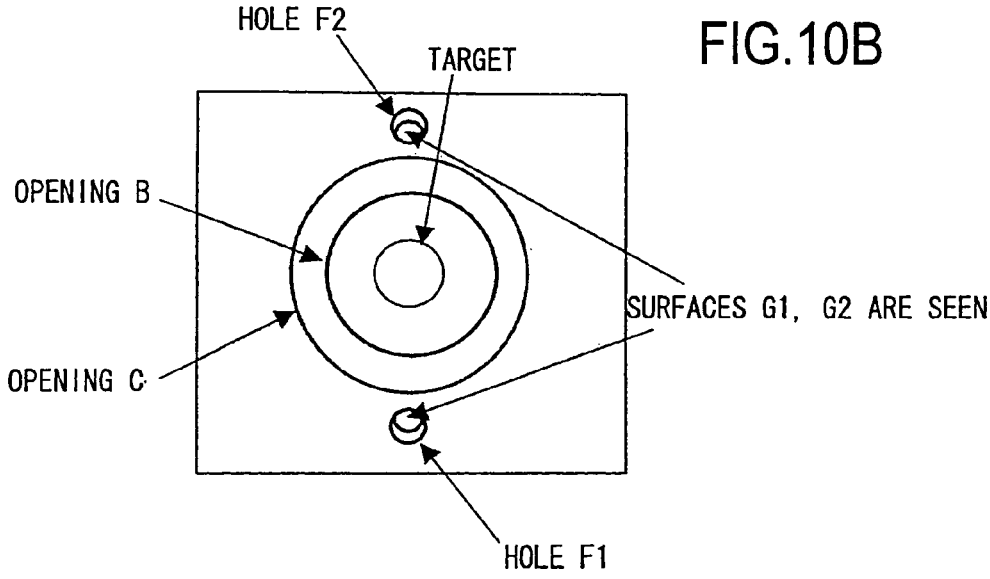
FIG. 10B is an explanatory diagram showing a target when viewed from an appropriate position.

Next, an aiming hole structure and a method of aligning an azimuth of an antenna according to a fifth embodiment of the present invention will be described with reference to FIG. 10. FIG. 10A is a sectional explanatory diagram showing an aiming hole structure and a method of aligning an azimuth of an antenna according to a fifth embodiment of the present invention, and FIG. 10B is an explanatory diagram showing a target when viewed from an appropriate position.

When the azimuth of the antenna is aligned using the aiming hole structure (an azimuth aligning instrument of the antenna) according to the embodiment of the present invention as described above, regulation is performed so that two aiming holes (an opening C on an operator's viewing side and an opening B on a target side) and the target form "concentric circles". However, when a distance between an operator's eye and the opening C on the operator's viewing side increases, a hole diameter seems to be small, and distinction precision of the "concentric circles" deteriorates.

Moreover, there is an individual difference in tolerance of deviation, that is, a degree of deviation judged as the "concentric circles", depending on operator's judgment. Especially, an operator unused to an aiming operation looks through the aiming hole structure by a wrong viewing method, sometimes misjudges the "concentric circles" and cannot regulate an appropriate direction.

According to the aiming hole structure and the method of aligning the azimuth of the antenna of the fifth embodiment, even the operator unused to the operation can look through the aiming hole in a correct manner, and precision of antenna azimuth regulation can be improved.

As shown in FIG. 10A, in the aiming hole structure of the fifth embodiment, other holes F1, F2 having a small opening diameter are disposed above and below the opening C of the aiming hole on the operator's viewing side (hereinafter referred to as the "opening C"). An operator judges, based on appearance of surfaces G1, G2 corresponding to bottom surfaces of the holes F1 and F2, whether or not deviation of a view field angle in the vertical direction and a distance from the aiming hole structure are appropriate, adjusts the viewing angles and distances so as to obtain a vertically equal appearance of the surfaces G1, G2, and can look through the aiming hole in the correct manner.

The holes F1 and F2 are holes formed into the same shape at position symmetric with respect to the center of the opening C of the aiming hole on the operator's viewing side, and here central axes are disposed in parallel with a central axis of the aiming hole.

Moreover, as characteristics of the fifth embodiment, the holes F1 and F2 are formed so that the surfaces G1 and G2 constituting the bottom surfaces of the holes can be seen well only in a case where the operator looks through the opening C at a correct angle from an appropriate distance. In FIG. 10A, a distance A is the appropriate distance.

The surfaces G1 and G2 are the bottom surfaces of the holes F1 and F2 having a small opening, and are disposed at positions symmetric with respect to the center of the opening C. Therefore, at a view field tilted upwards or downwards, one of the surfaces G1 and G2 is seen well, but the other surface is not seen at all, or there is a difference in seeing the surfaces, and both of the surfaces cannot equally be seen.

That is, as shown in FIG. 10B, when the operator looks through the aiming hole from a position where the surfaces G1 and G2 are similarly seen well, the operator looks through the aiming hole from the correct distance and at the angle which is not tilted vertically, and can correctly judge whether or not the openings C and B of the aiming hole structure and the target form "concentric circles" to correctly align the azimuth of the antenna. The operator may regulate the operator's position and posture so that the surfaces G1 and G2 can equally be seen, and even the operator unused to the operation can correctly align the azimuth of the antenna.

In the fifth embodiment, only two holes F are disposed, but three, four or more holes may be disposed as long as the number of the holes is two or more. When a large number of holes F are disposed, it is preferable to arrange the holes at positions symmetric with respect to the center of the opening C. When the holes F are disposed above and below the opening C and on opposite sides of the opening, it can be confirmed that the opening C is not tilted vertically or horizontally. Moreover, in a case where the operator regulates the distance and the angle to look through the aiming hole so that the surface G is equally seen from all of the holes F, the operator can look through the aiming hole from more correct distance and angle in a state in which the operator rightly faces the aiming hole, and azimuth alignment precision of the antenna can be improved.

Furthermore, a depth of the holes F1 and F2 and a diameter of the openings are formed into a depth and a size to such an extent that the surfaces G1 and G2 can be seen at a time when the operator looks through the aiming hole from the correct distance and angle. Since tolerances of the position and the angle where the operator looks through the hole are determined on the basis of the depth of the holes F1 and F2 and the size of the openings, the depth of the holes F1 and F2 and the diameter are determined in consideration of required antenna azimuth alignment precision and operation efficiency to such an extent that the required precision is kept without deteriorating the efficiency.

Furthermore, it is proposed that a material of the aiming hole structure on an opening B side corresponding to a backside (an inner side) of the surfaces G1 and G2 be changed or that a thickness from the surfaces G1 and G2 to the surface on the opening B side be reduced to easily transmit light, so that the surfaces G1 and G2 are easily seen. Alternatively, the holes F1 and F2 may be through holes, and the surfaces G1 and G2 may be openings.

In addition, the surfaces G1 and G2 may be painted in color different from that of inner surfaces of the holes F1 and F2 and the surface of the aiming hole structure provided with the opening C on the operator's viewing side so that the surfaces are easily seen.

Here, the hole F is formed into a circular sectional shape, but the present invention is not limited to this shape, and the hole may be formed into, for example, a groove-like shape which surrounds the opening C.

Figure 11A:
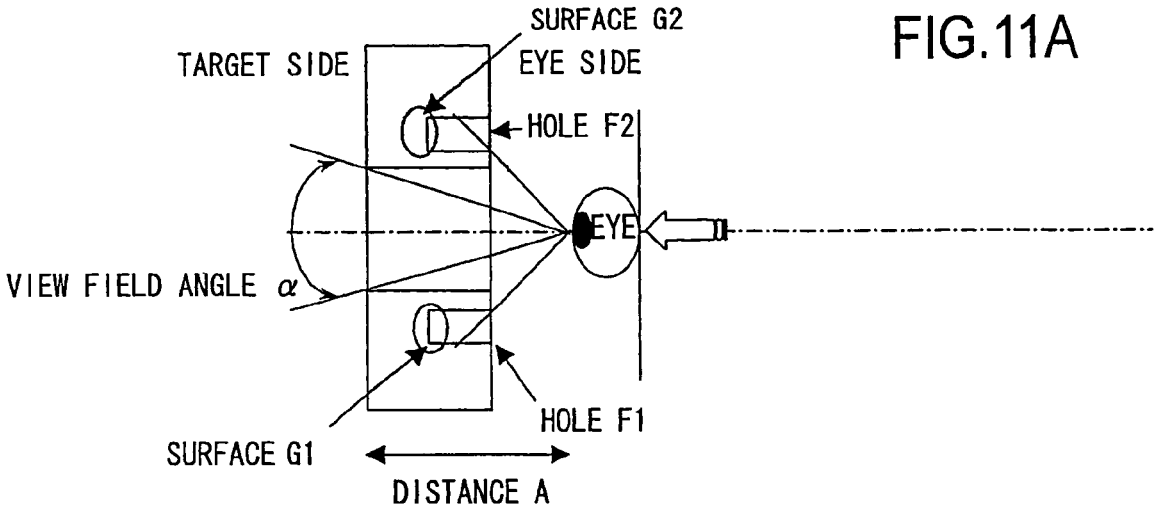
FIG. 11A is a sectional explanatory diagram showing a case where the azimuth of the antenna is aligned from an excessively close position by use of the aiming hole structure of the fifth embodiment.

Next, a way to look through an aiming hole structure according to the fifth embodiment will be described with reference to FIGS. 11 and 12. FIG. 11A is a sectional explanatory diagram showing a case where the azimuth of the antenna is aligned from an excessively close position by use of the aiming hole structure of the fifth embodiment, and FIG. 11B is an explanatory diagram of a target and a surface G when viewed in the case.

As shown in FIG. 11A, when the operator looks through the hole from an excessively close position, a distance A is excessively small, and bottom surfaces G1 and G2 of holes F1 and F2 come out of a view field angle (a range of a visible angle), and the operator cannot visually confirm the surfaces G1 and G2.

Figure 11B:
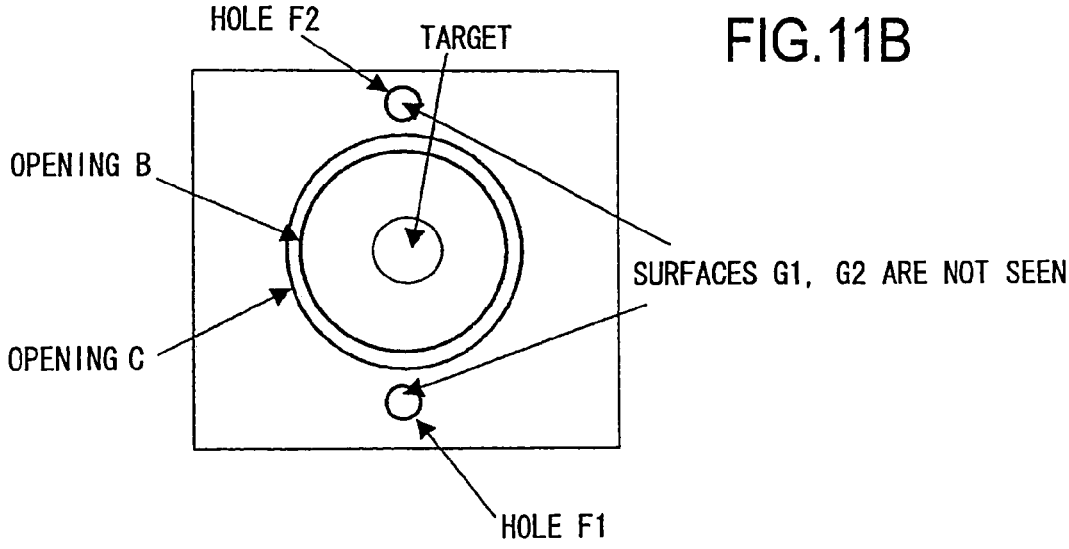
FIG. 11B is an explanatory diagram of a target and a surface G when viewed in this case.

As shown in FIG. 11B, when the operator looks from the excessively close position, a target is seen, but edge portions of the surfaces G1 and G2 as the bottom surfaces of the holes F1 and F2 cannot be seen at all. In consequence, the operator can recognize that this position is excessively close to the aiming hole.

Figure 12A:
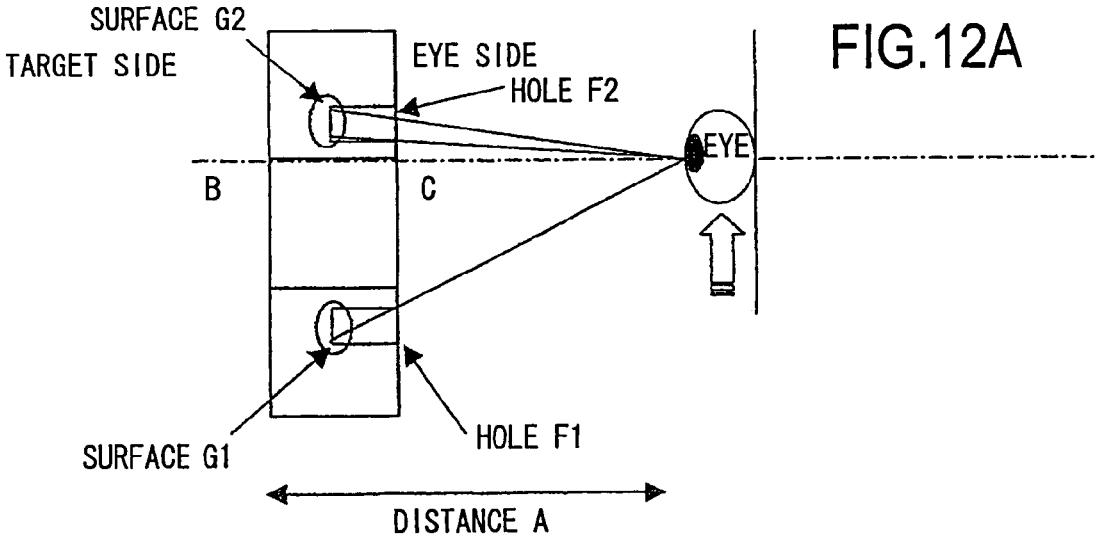
FIG. 12A is a sectional explanatory diagram showing a case where the azimuth of the antenna is aligned from an upwardly deviating position by use of the aiming hole structure of the fifth embodiment.
Figure 12B:
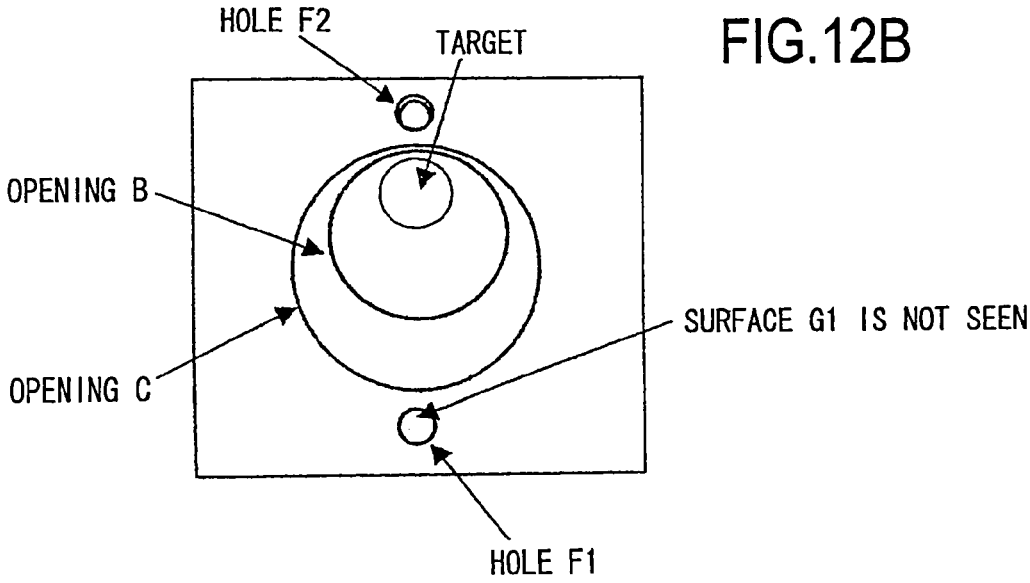
FIG. 12B is an explanatory diagram of a target and a surface G when viewed in this case.

FIG. 12A is a sectional explanatory diagram showing a case where the azimuth of the antenna is aligned from an upwardly deviating position by use of the aiming hole structure of the fifth embodiment, and FIG. 12B is an explanatory diagram of a target and a surface G when viewed in the case.

As shown in FIG. 12A, even when the operator looks from a position of an appropriate distance A but looks from the upwardly deviating position, a view field deviates upwards, a surface G2 of an upper hole F2 is seen, but a surface G1 of a lower hole F1 comes out of the view field, and cannot be seen.

Moreover, as shown in FIG. 12B, when the operator looks from the upwardly deviating position, the surface G1 of the hole F1 is not seen, and hence the operator sees that this position is not appropriate.

Figure 13:
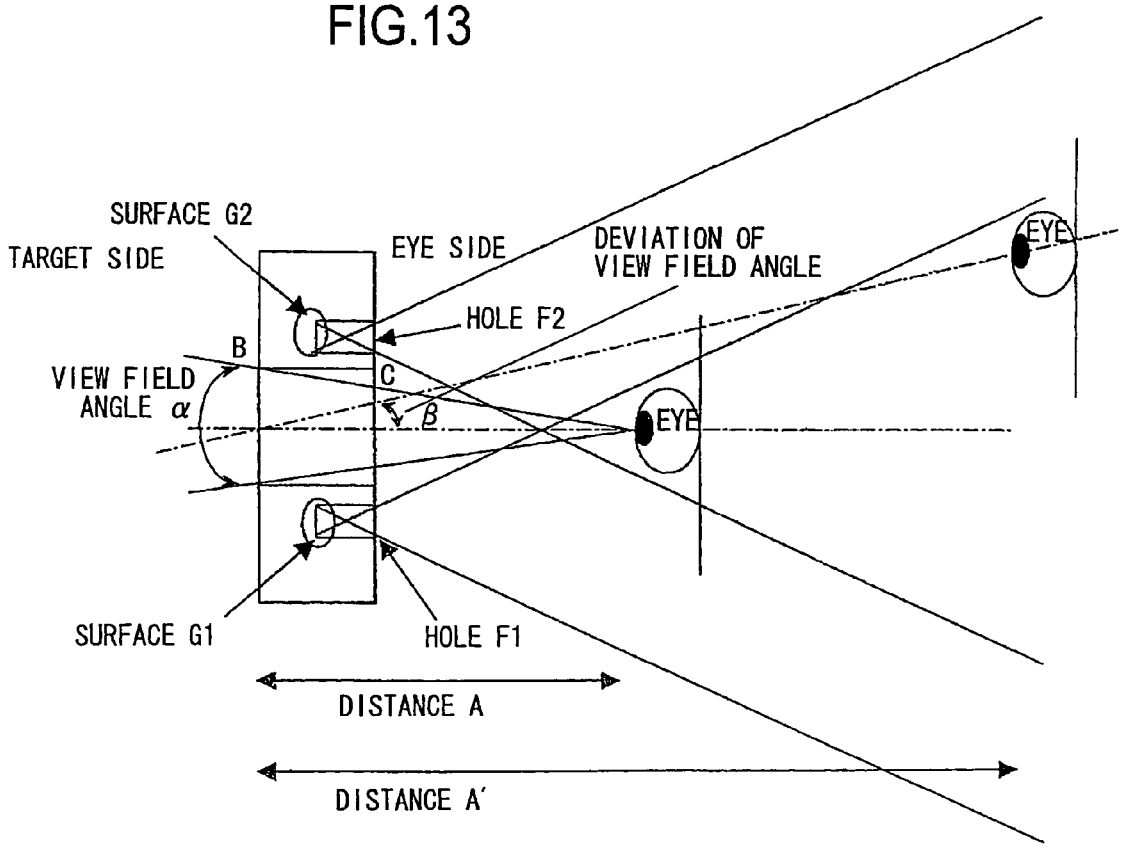
FIG. 13 is an explanatory diagram showing a view in a case where a distance increases according to the fifth embodiment.

Next, a case where a distance between an opening C of an aiming hole structure and an operator's eye is large will be described with reference to FIG. 13. FIG. 13 is an explanatory diagram showing a view in a case where a distance increases according to the fifth embodiment.

As shown in FIG. 13, a region where upper and lower surfaces G1 and G2 are seen enlarges, when the operator looks from a distance A' larger than the appropriate distance A. Specifically, when a view field angle is $\alpha$, deviation of the view field angle is $\beta$ and $\beta \leqq \alpha/2$, the surfaces G1 and G2 can be seen anywhere. However, when the distance increases, a view field seen at a tip of an opening B on the target side is reduced, and a region where the target is captured is reduced. Therefore, even when the distance increases, a result is scarcely different from a regulation result in a case where the operator looks from an appropriate position as long as the operator easily sees the region.

Moreover, when a size of a hole F is reduced, or a depth of the hole is changed, there can be a restriction on a distance along which the surfaces G1 and G2 can actually be viewed. For example, when the hole diameter is set to about 1 mm and a depth of the hole is set to 15 mm, it is not easy to visually recognize the surfaces G1 and G2 from a distance of 1 m, and an only shorter distance can be regarded as an appropriate distance.

Figure 14:
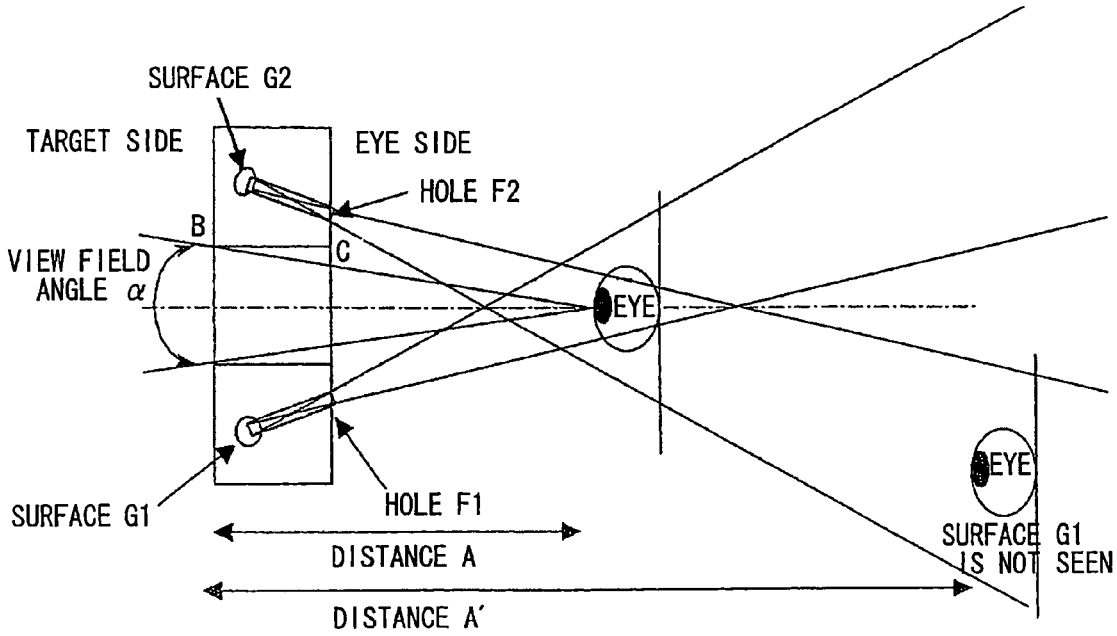
FIG. 14 is an explanatory diagram showing that an operator looks through holes F1 and F2 which are tilted when formed.

Furthermore, to more strictly restrict the distance, the holes F1 and F2 may be tilted when formed. FIG. 14 is an explanatory diagram showing that an operator looks through holes F1 and F2 which are tilted when formed.

As shown in FIG. 14, when the holes F1 and F2 are tilted and formed, an angle region where both of surfaces G1 and G2 are seen is largely reduced as compared with a case where the holes are not tilted, and there is a restriction on a distance constituting an appropriate region. Since tolerance of a view field angle is small, the surface G2 is seen but the surface G1 is not seen at a position of a distance A', and it is seen that it is inappropriate to align the azimuth through the aiming hole from this position.

According to the aiming hole structure and the method of aligning the azimuth of the antenna of the fifth embodiment of the present invention, there is proposed a method of aligning the azimuth of the antenna to adjust an aim from a position where G1 and G2 are equally seen by use of the aiming hole structure in which the holes F1 and F2 having small openings are disposed at position symmetric with respect to an opening C on an opening C side of the aiming hole structure on an operator's viewing side and in which the bottom surfaces G1 and G2 of the holes F1 and F2 are both seen only in a case where the distance from the opening C and an angle of a visual line are both in an appropriate region. When the operator confirms that the surfaces G1 and G2 of the holes F1 and F2 are both equally seen and simply looks through the aiming hole, the operator can look through the aiming hole at the appropriate distance and angle, even an operator unused to the operation can align the azimuth of the antenna from a correct position, and there is an effect that azimuth alignment precision can be improved.

Moreover, when color of the bottom surfaces G1 and G2 of the holes F1 and F2 is set to be different from surrounding color or a wall of the aiming hole structure corresponding to the back of the surfaces G1 and G2 is thinned to transmit light, there is an effect that it is easily confirmed whether or not both of the surfaces G1 and G2 are similarly seen.

Furthermore, when a size and a depth of the openings of the holes F1 and F2 are regulated, an appropriate region of a place viewed by the operator can freely be changed, and there is also an effect that the azimuth of the antenna can be regulated based on tolerance in accordance with an application of the antenna.

Embodiment 6

Figure 15A:
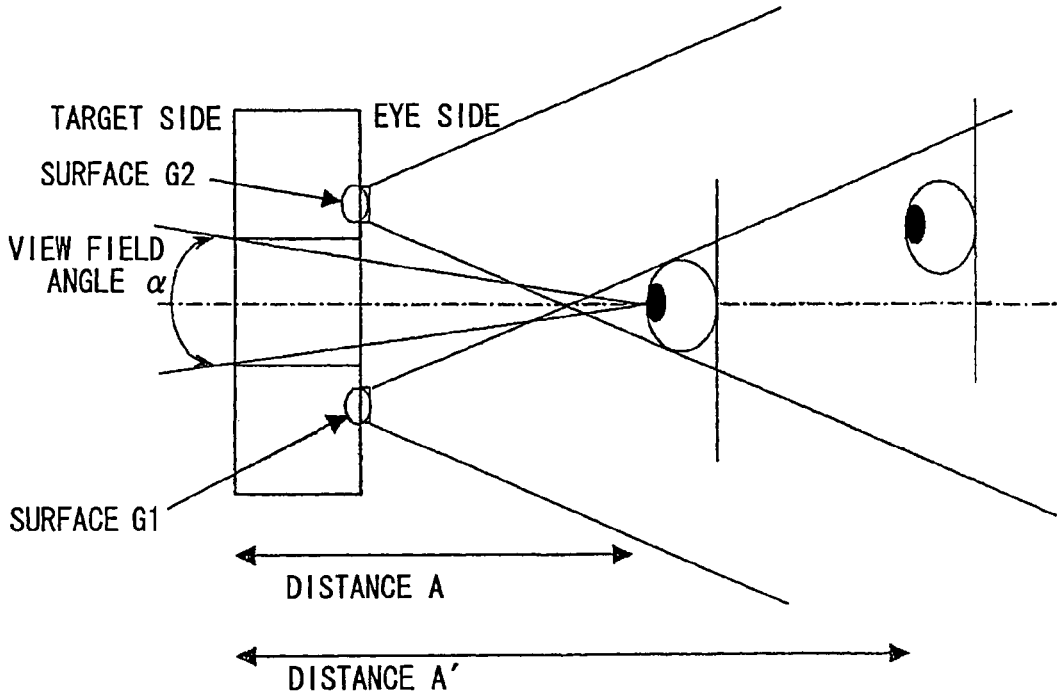
FIG. 15A is a sectional explanatory diagram showing an aiming hole structure and a method of aligning an azimuth of an antenna according to a sixth embodiment of the present invention.
Figure 15B:
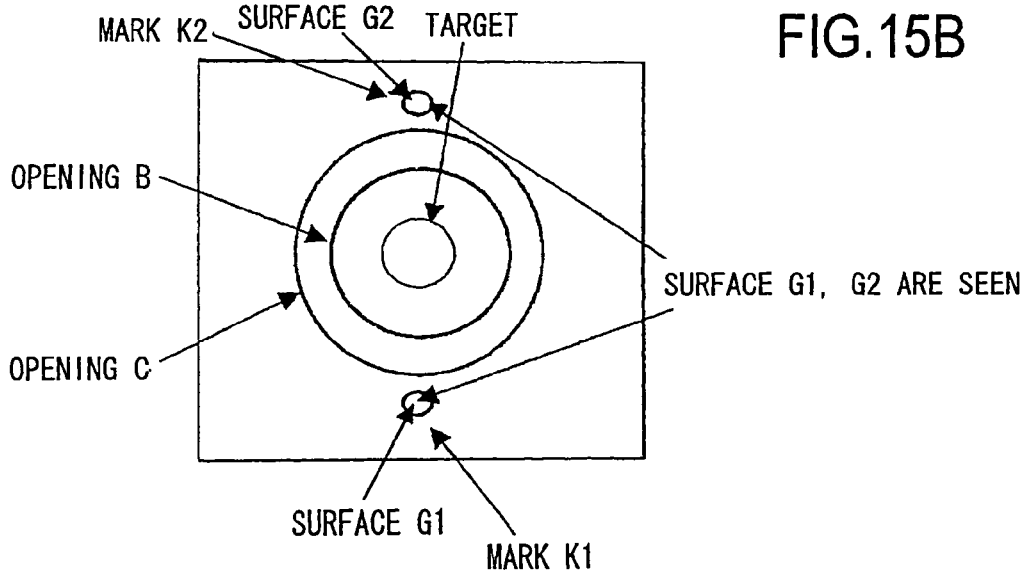
FIG. 15B is an explanatory diagram showing a target when viewed from an appropriate position.

Next, an aiming hole structure and a method of aligning an azimuth of an antenna according to a sixth embodiment of the present invention will be described with reference to FIG. 15. FIG. 15A is a sectional explanatory diagram showing the aiming hole structure and the method of aligning the azimuth of the antenna according to the sixth embodiment of the present invention, and FIG. 15B is an explanatory diagram showing a target when viewed from an appropriate position;

In the fifth embodiment, a constitution is buried in the aiming hole structure in order to reduce a view field angle of surfaces G1 and G2, but in the sixth embodiment, marks having surfaces G1 and G2 are disposed on the surface of the aiming hole structure on an opening C side to reduce a view field angle at which the surfaces G1 and G2 are seen.

As shown in FIG. 15A, in the aiming hole structure of the sixth embodiment, marks K1 and K2 are disposed above and below an opening C at the surface of the aiming hole structure on the opening C side. The marks K1 and K2 include the surfaces G1 and G2 and means for reducing an angle to such an extent that the surfaces G1 and G2 can be viewed.

Specifically, the surfaces G1 and G2 are formed in conspicuously bright color in the same manner as in the fifth embodiment, and as the means for reducing the view field angle, for example, a cylindrically protruding portion which surrounds the surfaces G1 and G2 is supposedly disposed to reduce a region where the surfaces G1 and G2 are seen. Moreover, light may be refracted using a lens, a prism or the like to reduce a view field angle. Alternatively, the surfaces G1 and G2 may be formed using a liquid crystal element or a polarization element in which the view field angle is originally limited.

The number and shape of the marks may arbitrarily be changed in the same manner as in the fifth embodiment.

Furthermore, as shown in FIG. 15B, a region where both of the surfaces G1 and G2 can be seen is limited, so that the aiming hole structure can be looked from an appropriate region.

In consequence, when the operator simply confirms that the surfaces G1 and G2 are both equally seen, the operator can constantly look through the aiming hole structure at correct distance and angle to align the azimuth of the antenna, and precision of the azimuth alignment of the antenna can be improved regardless of operator's skill.

According to the aiming hole structure and the method of aligning the azimuth of the antenna of the sixth embodiment of the present invention, there is provided the method of aligning the azimuth of the antenna in which the aim is focused from the position where the surfaces G1 and G2 are equally seen by use of the aiming hole structure in which the marks K1, K2 including the surfaces G1 and G2 where the view field angle is reduced are disposed at the positions symmetric with respect to the opening C on the opening C side of the aiming hole structure on the operator's viewing side and in which the surfaces G1, G2 of the marks K1, K2 are both seen, only when viewed from the region where the distance from the opening C and an angle of a visual line are both appropriate. Therefore, when the operator simply confirms that both of the surfaces G1, G2 of the marks K1, K2 can equally be seen to look through the aiming hole, the operator can look through the aiming hole at the appropriate distance and angle, even the unused operator can align the azimuth of the antenna from the correct position, and there is an effect that the precision of the azimuth alignment can be improved.

Furthermore, in the aiming hole structure of the sixth embodiment, the marks K1, K2 are attached from the outside, and this produces effects that the marks can be formed of a material different from that of the aiming hole structure, a degree of freedom in design is raised, the shapes and detachment and attachment places of the marks K1 and K2 can easily be changed and the number of the marks K1 and K2 can easily be increased or decreased.

Embodiment 7

Next, an aiming hole structure and a method of aligning an azimuth of an antenna according to a seventh embodiment of the present invention will be described with reference to FIGS. 16 and 17. FIG. 16 is an appearance perspective view of the aiming hole structure according to the seventh embodiment of the present invention, FIG. 16A is a back-surface perspective view, and FIG. 16B is a front-surface perspective view.

Figure 17A:
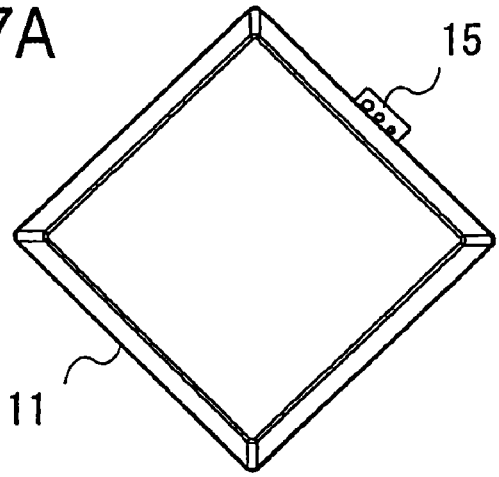
FIG. 17A is a front view of the aiming hole structure according to the seventh embodiment.
Figure 17B:
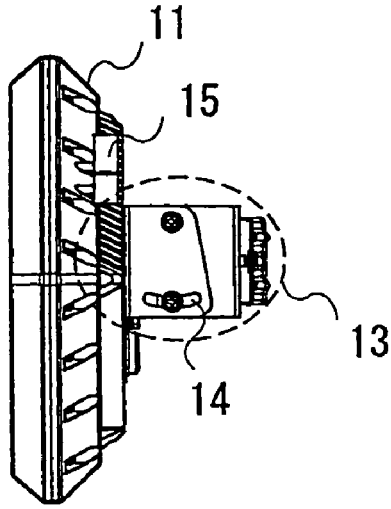
FIG. 17B is a side view.
Figure 17C:
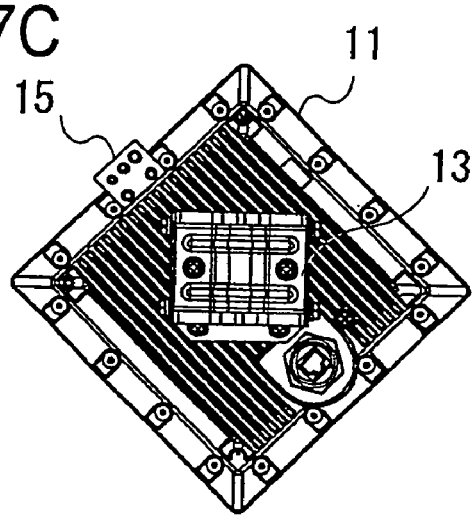
FIG. 17C is a back view.

Moreover, FIG. 17A is a front view of the aiming hole structure according to the seventh embodiment, FIG. 17B is a side view, and FIG. 17C is a back view.

Figure 16A:
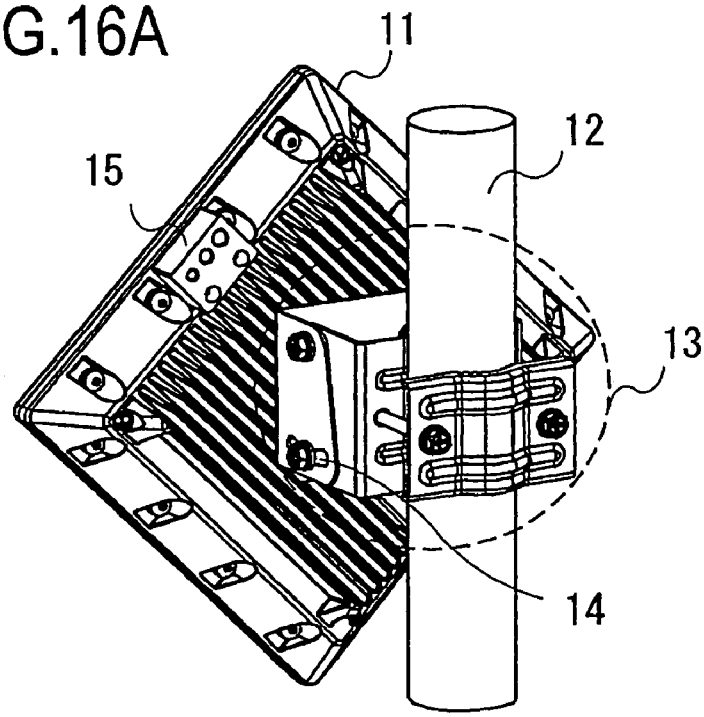
FIG. 16A is a back-surface perspective view of an aiming hole structure according to a seventh embodiment of the present invention.

As shown in FIG. 16A, in the same manner as in the first to sixth embodiments, an aiming hole structure 15 according to the seventh embodiment is projected from a contour line of an antenna 11 and attached, and the antenna 11 is further fixed to an attachment pole 12 via an antenna attachment fitting 13. The antenna attachment fitting 13 is provided with an elevation angle regulation mechanism 14. Furthermore, an operator looks through an aiming hole disposed at the aiming hole structure 15 from a back surface side to regulate the azimuth of the antenna.

Figure 16B:
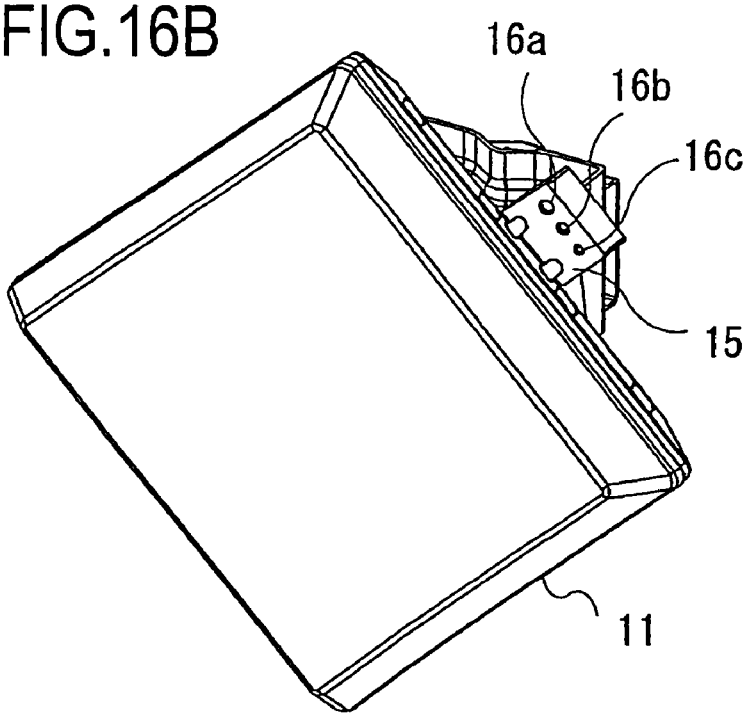
FIG. 16B is a front-surface perspective view.

As shown in FIG. 16B, the aiming hole structure 15 of the seventh embodiment includes a plurality of aiming holes 16*a*, 16*b* and 16*c* having different opening diameters. In the third embodiment, an example in which a plurality of aiming holes having different opening diameters are disposed has been described, but further in the seventh embodiment, each of the aiming holes is formed into a tapered shape in which a diameter of an opening on an operator's viewing side is set to be larger than that of an opening on a target side as described in the first embodiment. Although not clearly described with reference to FIG. 16, an opening on the back surface side is larger than an opening on a front surface side.

Here, sizes of the opening diameters of the aiming holes 16*a*, 16*b* and 16*c* are set so that 16*a* (large)>16*b* (intermediate)>16*c* (small).

Moreover, when the azimuth of the antenna is aligned using the aiming hole structure of the seventh embodiment, in the same manner as in the third embodiment, the azimuth is first coarsely regulated with the aiming hole 16*a* having a large diameter, and then the azimuth is successively finely regulated with the aiming holes 16*b* and 16*c* having smaller diameters in this order.

In addition, the aiming holes can selectively be used, depending on a difference of a distance to a target. When the distance is small, the aiming hole having the large diameter is used so that the whole image of the target falls in the view field. When the distance is large, the aiming hole having the small diameter is used.

It is to be noted that when the distance is large, the azimuth is not aligned with the small aiming hole at once, and the azimuth may first be coarsely regulated with the large aiming hole so that the target falls in the view field, and then finely regulated with the small aiming hole.

In consequence, an operation of aligning the azimuth of the antenna is facilitated, and efficiency can be improved.

Further in the seventh embodiment, since the diameters of the openings of the aiming holes 16*a*, 16*b* and 16*c* on the operator's viewing side are set to be larger than those of the openings on the target side, deviation of concentric circles when viewed can be enlarged, and precision of the azimuth alignment of the antenna can be improved.

Moreover, an azimuth aligning instrument as the aiming hole structure according to Embodiments 1 to 7 described above may be formed integrally with the antenna or formed as an independent structure separately from the antenna, or attached to the antenna later.

Figure 19A:
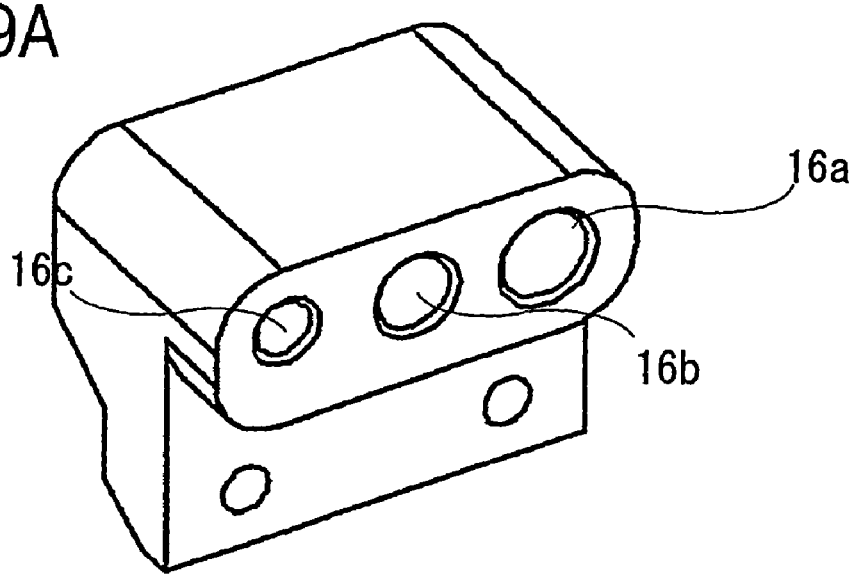
FIG. 19A is a perspective view of an azimuth aligning instrument (Constitution Example 2) according to the seventh embodiment.
Figure 19B:
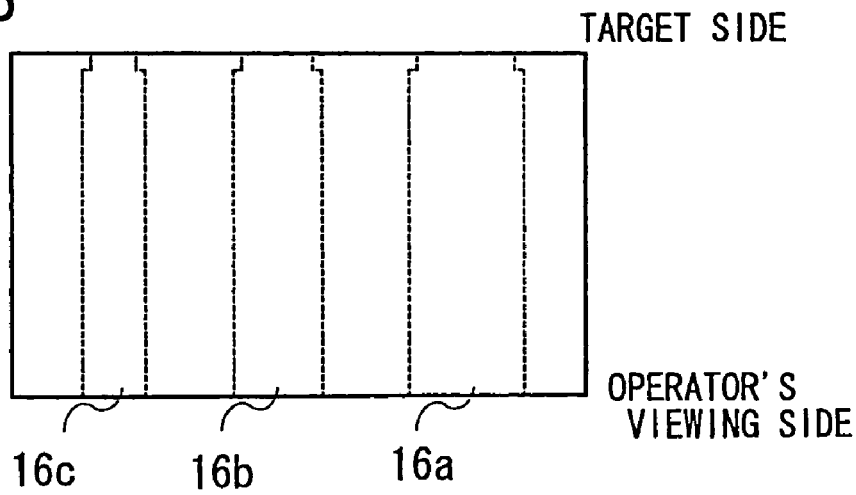
FIG. 19B is an explanatory diagram of a shape of the aiming hole.
Figure 20:
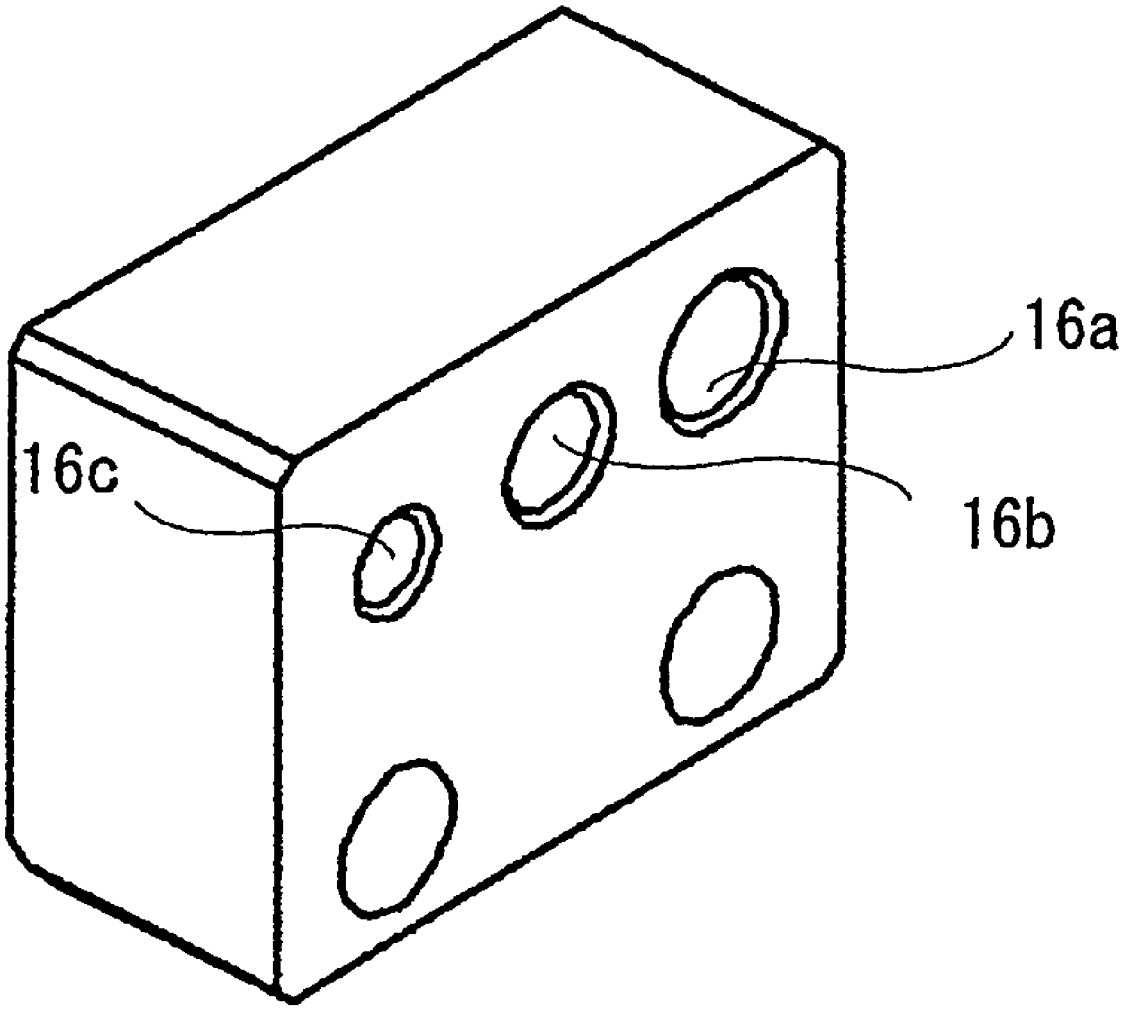
FIG. 20 is a perspective view of an azimuth aligning instrument (Constitution Example 3) according to the seventh embodiment.

Here, constitution examples of the azimuth aligning instrument constituted separately from the antenna according to the seventh embodiment will be described with reference to FIGS. 18, 19 and 20. FIGS. 18, 19 are perspective views of the azimuth aligning instrument (Constitution Example 1 or Constitution Example 2) of the seventh embodiment and explanatory diagrams showing shapes of aiming holes, and FIG. 20 is a perspective view of the azimuth aligning instrument (Constitution Example 3) of the seventh embodiment.

Figure 18A:
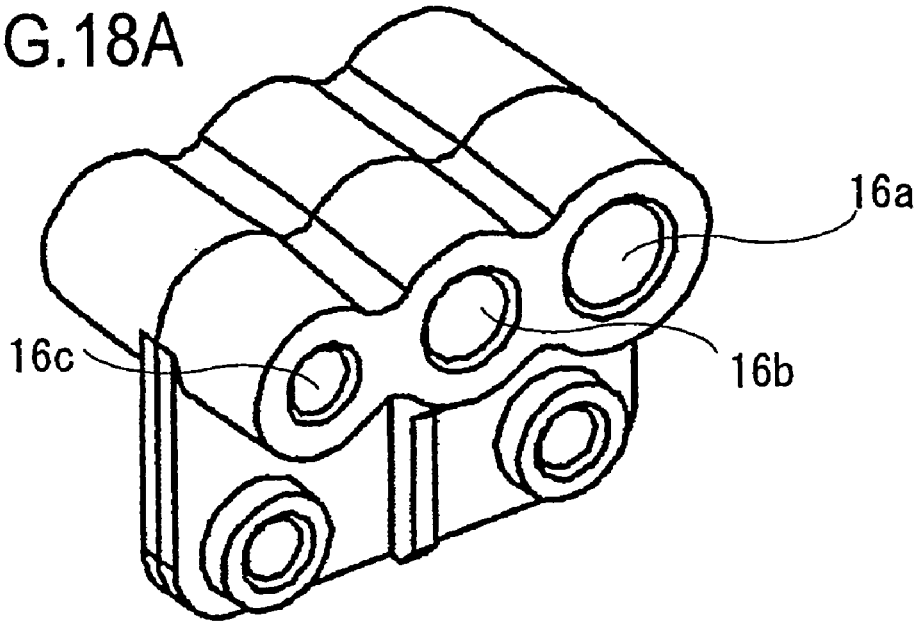
FIG. 18A is a perspective view of an azimuth aligning instrument (Constitution Example 1) according to the seventh embodiment.

As shown in FIG. 18A, the azimuth aligning instrument (Constitution Example 1) of the seventh embodiment is constituted separately from the antenna, attached to the antenna later, provided with, at an upper part thereof, the aiming holes 16*a*, 16*b* and 16*c* having different hole diameters, and provided with, at a lower part thereof, two holes for fastening threads in fixing the azimuth aligning instrument to the antenna with the threads.

Moreover, as shown in FIG. B, in the azimuth aligning instrument (Constitution Example 1), a hole side surface of each of the three aiming holes is formed to be tapered, and a diameter of the opening on the operator's viewing side is set to be larger than that of the opening on the target side.

In the azimuth aligning instrument (Constitution Example 2), as shown in FIG. 19(*a*), an upper part provided with aiming holes 16*a* to 16*c* is formed integrally with a lower part provided with thread fastening holes. As shown in (b), a stepped portion is disposed close to an opening on a target side to set a diameter of the opening on the target side to be larger than that of the opening on the operator's viewing side.

Figure 18B:
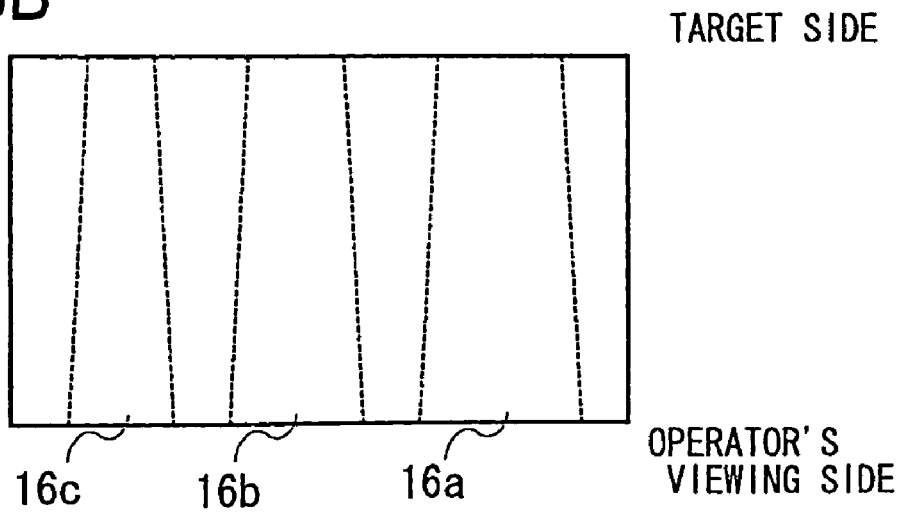
FIG. 18B is an explanatory diagram of a shape of an aiming hole.

Moreover, the aiming holes of Constitution Example 2 may be formed into a tapered shape as shown in FIG. 18B. Similarly, the aiming holes of Constitution Example 1 may be formed into a stepped shape as shown in FIG. 19B.

Furthermore, as shown in the azimuth aligning instrument (Comparative Example 3) of FIG. 20, the instrument may be formed into a simple shape having little unevenness on the surface thereof. In consequence, manufacturing of the azimuth aligning instrument is facilitated.

Shapes of aiming holes of Comparative Example 3 may be the tapered shape shown in FIG. 18(*b*) or the stepped shape shown in FIG. 19(*b*).

That is, outer shapes shown in FIGS. 18, 19(*a*) and 20 may be provided with the aiming holes having the tapered shape or the stepped shape.

According to the aiming hole structure and the method of aligning the azimuth of the antenna of the seventh embodiment of the present invention, there is provided the method of aligning the azimuth of the antenna in which the azimuth is coarsely regulated with the aiming hole having the large hole diameter and then finely regulated with the aiming hole having the small hole diameter by use of the aiming hole structure 15 including the plurality of aiming holes 16*a*, 16*b* and 16*c* having different sizes of diameters of openings and including the diameter of the opening on the operator's viewing side formed to be larger than that of the opening on the target side. Therefore, efficiency of an operation of aligning the azimuth of the antenna can be improved. Moreover, since each aiming hole is formed into the tapered shape, there are effects that concentric circles at each aiming hole can easily be distinguished and that precision of the azimuth alignment can be improved.

It is to be noted that it has been described here that the number of the aiming holes is set to three, the present invention is not limited to this number, and two, four or more holes may be formed.

Moreover, according to the first to seventh embodiments of the present invention, since the azimuth aligning instrument is formed as a structure separately from the antenna, the azimuth aligning instrument having optimum outer shape and hole shape can be attached to the antenna to align the azimuth based on individual conditions such as the shape of the antenna, an antenna installation position and a positional relation with the antenna as a target, and the precision of the azimuth alignment can be improved.

Furthermore, when the antenna and the azimuth aligning instrument are manufactured separately from each other, manufacturing steps can be simplified to reduce manufacturing costs. When the antenna and the instrument are integrally formed, there is an effect that needs for an operation of attaching the azimuth aligning instrument to the antenna are obviated. The constitution may appropriately be selected based on user's demands.

INDUSTRIAL APPLICABILITY

The present invention is suitable for a method of aligning an azimuth of an antenna in which the azimuth of a pencil beam antenna can economically and precisely be aligned and in which even an operator unused to an operation can align the azimuth from an appropriate position, so that precision of the azimuth alignment can be improved.

What is claimed is:

1. A method of aligning an azimuth of a directional antenna by use of an antenna azimuth aligning instrument to be attached to the antenna for use in radio communication, the azimuth aligning instrument including an aiming hole whose central axis is constituted in parallel with a main beam azimuth of the antenna and in which a diameter of an opening on an operator's viewing side is set to be larger than that of an opening on a target side, wherein the azimuth of the antenna is aligned using the centers of the two openings of the aiming hole as aims for a target.

2. The method of aligning the azimuth of the antenna according to claim 1, wherein the azimuth aligning instrument includes the aiming hole provided with a stepped portion which is disposed between the opening on the target side and the opening on the operator's viewing side along the same central axis and which has a diameter smaller than the diameter of the opening on the operator's viewing side, and the azimuth of the antenna is aligned using the centers of the two openings of the aiming hole and the center of the diameter of the stepped portion as the aims for the target.

3. A method of aligning an azimuth of a directional antenna by use of an antenna azimuth aligning instrument to be attached to the antenna for use in radio communication, the azimuth aligning instrument including an aiming hole whose central axis is constituted in parallel with a main beam azimuth of the antenna, and a plurality of holes or marks disposed at positions symmetric with respect to the center of an opening of the aiming hole in the vicinity of the opening on an operator's viewing side and configured to be viewed at specific distances and angles from the aiming hole, wherein the azimuth of the antenna is aligned using the center of the opening of the aiming hole on the operator's viewing side and the center of an opening on a target side as aims for a target from a position where the plurality of holes or marks of the azimuth aligning instrument are equally seen.

4. A method of aligning an azimuth of a directional antenna by use of an antenna azimuth aligning instrument to be attached to the antenna for use in radio communication, the azimuth aligning instrument including a plurality of aiming holes in which a diameter of an opening on an operator's viewing side is set to be larger than that of an opening on a target side and which have different hole diameters, wherein the centers of the two openings of each of the aiming holes are regarded as aims for a target, and the aiming hole having such a hole diameter as to aim the target is successively changed to the aiming hole having a smaller hole diameter to align the azimuth of the antenna.

* * * * *